US012708185B2

(12) United States Patent
Foster

(10) Patent No.: US 12,708,185 B2
(45) Date of Patent: Aug. 18, 2026

(54) METHODS AND SYSTEMS FOR A HAIR LENGTHENING DEVICE

(71) Applicant: Chloe Ellyse Foster, Ann Arbor, MI (US)

(72) Inventor: Chloe Ellyse Foster, Ann Arbor, MI (US)

( * ) Notice: Subject to any disclaimer, the term of this patent is extended or adjusted under 35 U.S.C. 154(b) by 0 days.

(21) Appl. No.: 18/776,101

(22) Filed: Jul. 17, 2024

(65) Prior Publication Data

US 2025/0024926 A1 Jan. 23, 2025

Related U.S. Application Data

(60) Provisional application No. 63/528,329, filed on Jul. 21, 2023.

(51) Int. Cl.

| | |
|---|---|
| ***A45D 2/00*** | (2006.01) |
| ***A45D 7/00*** | (2006.01) |
| *A45D 8/34* | (2006.01) |
| *A45D 20/02* | (2006.01) |

(52) U.S. Cl.

CPC ..... *A45D 2/001* (2013.01); *A45D 7/00* (2013.01); *A45D 8/34* (2013.01); *A45D 20/02* (2013.01)

(58) Field of Classification Search

CPC . A45D 7/00; A45D 2/00; A45D 2/001; A45D 2/002; A45D 2/2492; A45D 2002/003; A45D 2002/007; A45D 8/40; A45D 2/127; A45D 2/125; A45D 2007/002; A45D 8/00; A45D 8/001; A45D 8/34; A45D 20/02

USPC ..... 132/210

See application file for complete search history.

(56) References Cited

U.S. PATENT DOCUMENTS

| | | | | | |
|---|---|---|---|---|---|
| 2,524,266 | A | * | 10/1950 | Yolanda | A45D 2/18 132/246 |
| 3,590,829 | A | * | 7/1971 | Parisi | A45D 2/127 132/226 |
| 3,871,388 | A | * | 3/1975 | Leoci | A45D 2/00 132/223 |
| 4,962,775 | A | * | 10/1990 | Squatrito | A45D 2/14 132/246 |
| 5,456,963 | A | * | 10/1995 | Bettanny | A45D 7/045 428/512 |

(Continued)

OTHER PUBLICATIONS

Hair Gloves(R). [online]. Hair Glove, Feb. 26, 2023. [retrieved on Apr. 21, 2025]. Retrieved from the Internet Archive: <URL: https://web.archive.org/web/20230226233316/https://www.hairglove.com/collections/hair-glove> (Year: 2023).*

(Continued)

*Primary Examiner* — Tatiana L Nobrega
*Assistant Examiner* — Courtney N Huynh
(74) *Attorney, Agent, or Firm* — McCoy Russell LLP

(57) ABSTRACT

Systems and methods are provided for lengthening curly or coily hair with a hair lengthening device. The hair lengthening device includes a mesh structure, a first flexible wire arranged at a top edge, a second flexible wire arranged at a bottom edge, and a plurality of hooks along a side edge configured to engage with the mesh structure. The method includes wrapping the hair lengthening device around a section of hair, engaging the plurality of hooks with the mesh structure, and removing the hair lengthening device after a period of time.

11 Claims, 8 Drawing Sheets

(56) References Cited

U.S. PATENT DOCUMENTS 5,727,575 A * 3/1998 Rontal ..... A45D 8/34 132/273
5,799,672 A * 9/1998 Hansbury ..... A45D 8/34 132/273
6,722,375 B1 * 4/2004 Falls ..... A45D 2/18 132/246
7,543,591 B1 * 6/2009 Munsil ..... A45D 19/018 132/270
8,069,862 B1 * 12/2011 Clark ..... A45D 2/001 132/119
8,939,160 B2 * 1/2015 Falcucci ..... A45D 19/012 132/270
9,439,489 B1 * 9/2016 Townsell ..... A45D 8/34
2002/0000238 A1 * 1/2002 Stewart ..... A45D 8/34 132/246
2004/0231690 A1 * 11/2004 De Benedictis ... A44B 18/0065 132/270
2006/0090233 A1 * 5/2006 Botcher ..... F41H 1/02 2/2.5
2013/0199562 A1 * 8/2013 Parker ..... A45D 8/40 132/273
2014/0326271 A1 * 11/2014 Fulgham ..... A45D 8/34 132/223
2019/0142130 A1 * 5/2019 Chang ..... A45D 8/34 132/246
2020/0178634 A1 * 6/2020 Brown ..... A42B 1/041
2020/0315309 A1 * 10/2020 Chang ..... A45D 8/36

OTHER PUBLICATIONS

"Non damaging temporary hair straightening techniques? Other than wrapping?" [Forum Thread] The Long Hair Community. 3 pages. Posted Sep. 7, 2014. Retrieved on Oct. 2, 2024. Retrieved from the Internet: URL:https://forums.longhaircommunity.com/showthread.php?t=126030>. (Year: 2014).*

Screen captures from YouTube video clip entitled "How to Wear a Hair Glove(R)". 1 page, uploaded on May 15, 2018 by Hair Glove. Retrieved from the Internet: <URL: https://www.youtube.com/watch?v=EJVI2rz6DGk> (Year: 2018).*

* cited by examiner

METHODS AND SYSTEMS FOR A HAIR LENGTHENING DEVICE

TECHNICAL FIELD

Embodiments of the subject matter disclosed herein relate to a hair styling tool and more particularly, to a tool and method to prevent shrinkage in curly hair.

BACKGROUND

When wet curly or coily hair dries it often contracts as the curls and coils form, which results in hair that appears shorter than when the hair was wet. The difference in the length of wet curly or coily hair compared to dry curly or coily hair may be referred to as shrinkage. Heat styling tools such as hair straighteners, curling wands, or hot rollers may be used to alter the hair's natural curling pattern and reduce shrinkage. However, regularly applying heat to hair can cause dryness, split ends, and the loss of hair elasticity, and can be time consuming for the user. Heatless styling tools such as overnight rollers may be used to style hair, but may disrupt the natural curl pattern of the hair.

SUMMARY

In one example, a hair lengthening device may be designed to stretch and lengthen curly or coily hair without requiring heat. While the hair lengthening device may be used on different hair types, the hair lengthening device is particularly suited for use with type 3 or type 4 hair. By tightly wrapping the hair lengthening device around a section of hair while the hair is damp and allowing the hair to dry while wrapped in the hair lengthening device, the dry hair may appear longer and/or less tightly curled than it would if it had dried naturally.

The hair lengthening device may be constructed out of a breathable mesh that may be wrapped around a section of hair. The breathable mesh permits airflow through the hair lengthening device and around the wrapped section of hair, allowing damp hair to dry within the hair lengthening device. The hair lengthening device may have a flexible wire affixed to a top edge of the device and a bottom edge of the device, as well as a plurality of hooks arranged on a side edge. The flexible wires allow the device to hold its shape when wrapped around a section of hair. The hooks may be hooked onto the breathable mesh to secure the position of the hair lengthening device when it is wrapped around the hair. The tightness of the hair lengthening device can be adjusted based on the position of the hooks within the breathable mesh.

The above advantages and other advantages and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION OF THE FIGURES

Figure 1:
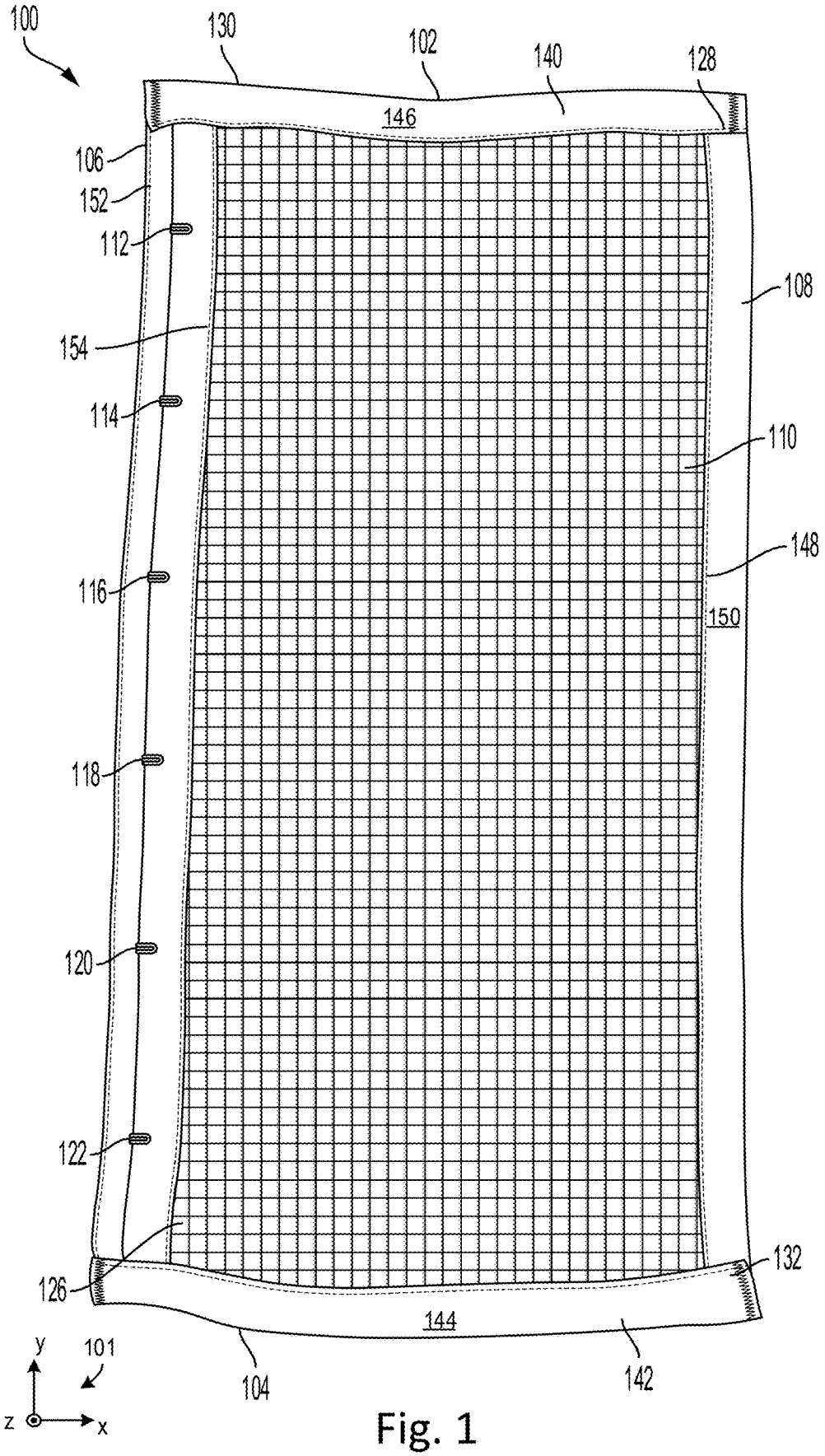
FIG. 1 is a front view of the hair lengthening device.
Figure 2:
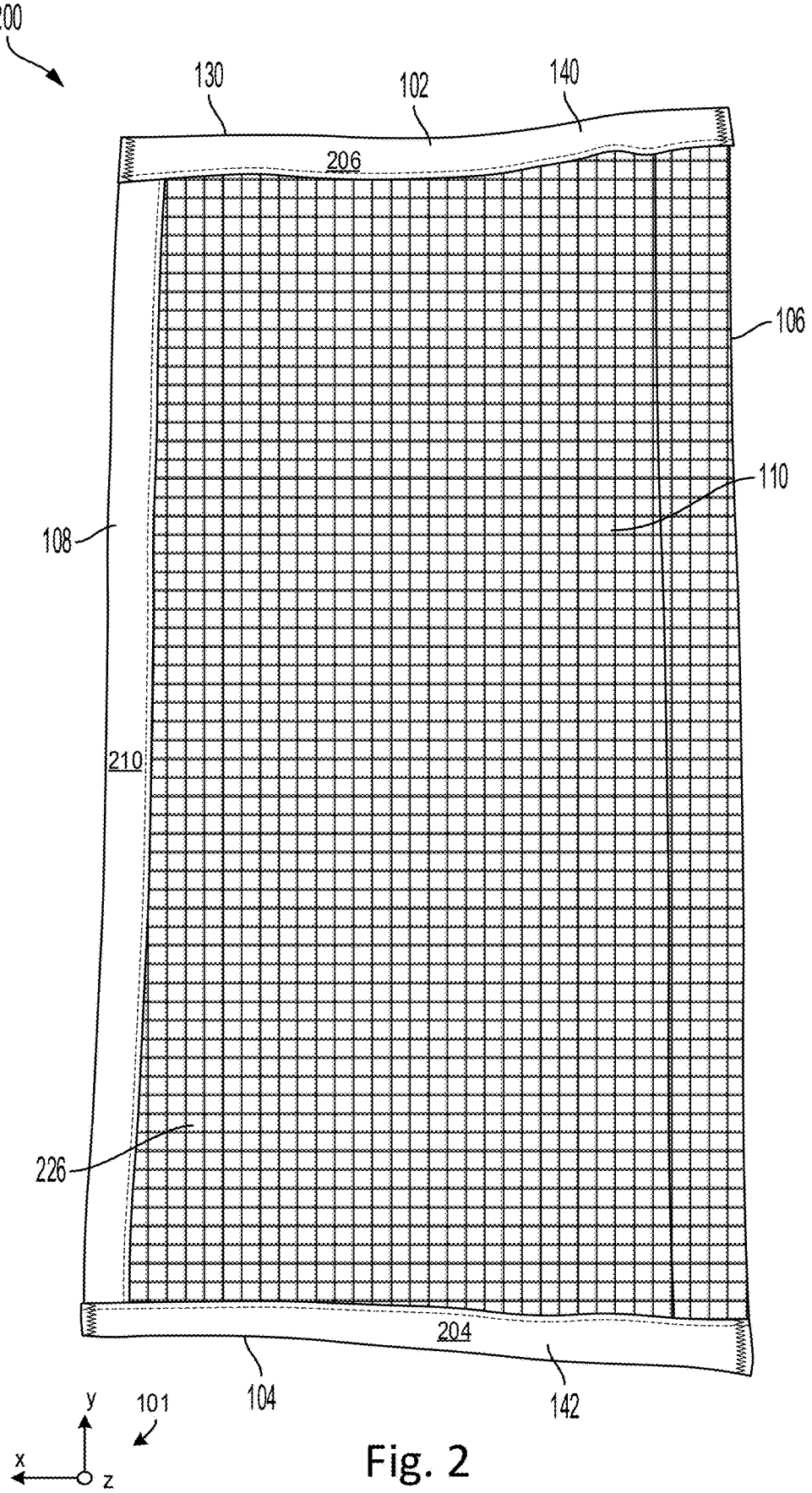
FIG. 2 is a back view of the hair lengthening device.
Figure 3:
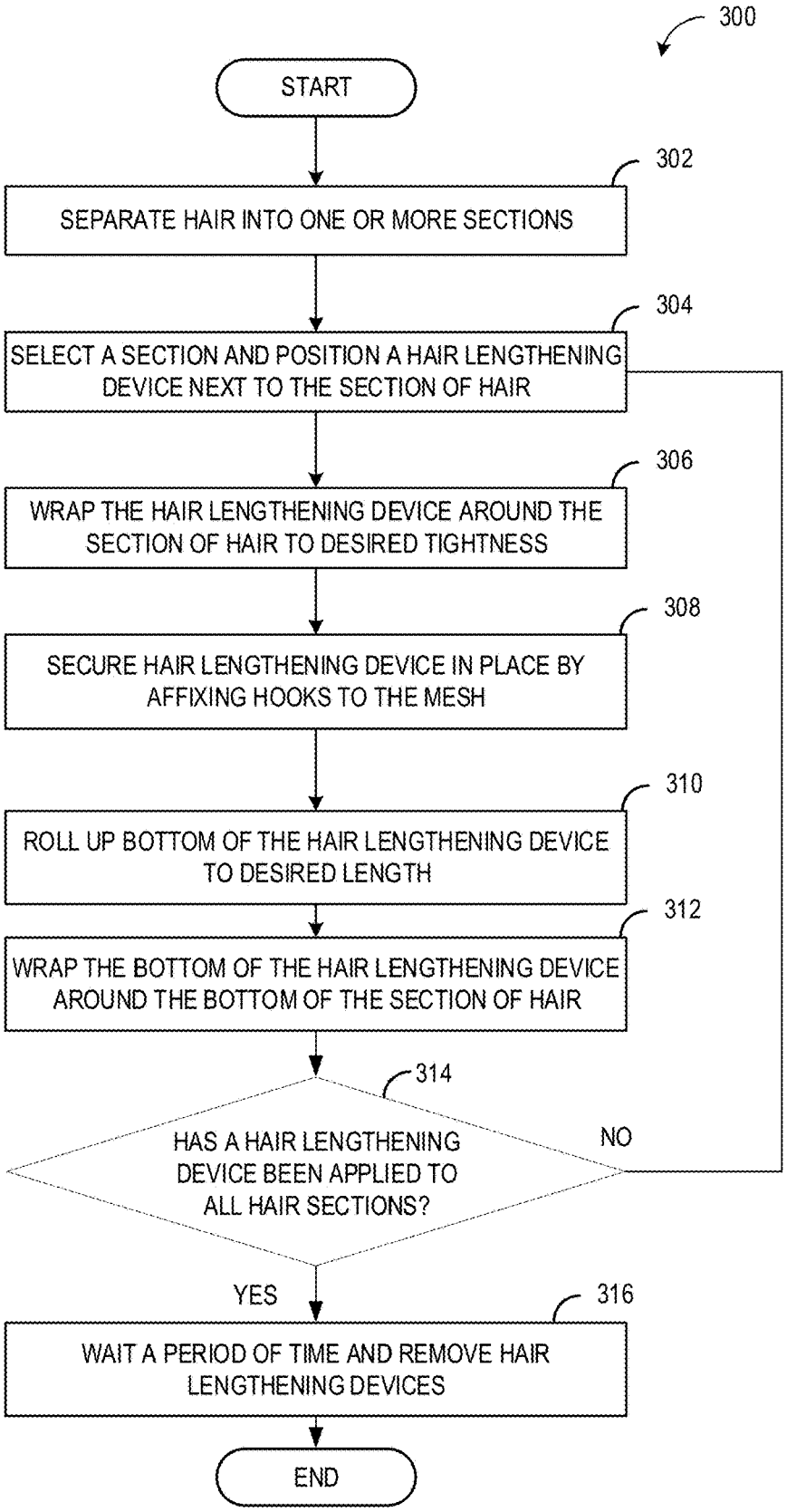
FIG. 3 is a flowchart describing a method to use the hair lengthening device.

This description and embodiments of the subject matter disclosed herein relate to an apparatus and method for lengthening hair, particularly type 3 and type 4 hair. The apparatus may be a hair lengthening device comprised of a rectangular piece of mesh fabric that may be wrapped around a section of damp or wet hair. The hair lengthening device may be secured in place by lengths of plastic coated wire at the top and bottom of the hair lengthening device as well as by a plurality of hooks on one side of the apparatus. FIGS. 1-2 are schematic images of the hair lengthening device. FIG. 3 is a flowchart describing the process of using the hair lengthening device to lengthen hair. FIGS. 4-8 depict the hair lengthening device being used on hair according to various steps of the method described in FIG. 3.

FIG. 1 is a front view 100 of the hair lengthening device 130. A coordinate system 101 is shown comprising three axes, namely an x-axis parallel to a horizontal direction, a y-axis parallel to a vertical direction, and a z-axis perpendicular to each of the x- and y-axes. For reference, the coordinate system 101 is included in FIGS. 1-2.

The hair lengthening device 130 may have a front side 126. The front side 126 may be substantially rectangular in shape and may be defined by a top 102, a bottom 104, a first side 106 and a second side 108. The top 102 and the bottom 104 may have the same length and the first side 106 and the second side 108 may have the same length and may be longer than the top 102 and the bottom 104. In one example, the top 102 and the bottom 104 may be 7 inches long along the x-axis and the first side 106 and the second side 108 may be 13 inches long along the y-axis. However, other dimensions are possible, and dimensions may be optimized to accommodate different lengths and thicknesses of hair. A mesh structure 110 may extend between the top 102, the bottom 104, the first side 106 and the second side 108. The mesh structure 110 may be substantially rectangular in shape and have a smooth, satin-like texture on the front side 126 of the hair lengthening device 130. The smooth texture of the mesh structure 110 may reduce the amount of frizz induced in hair when the mesh structure 110 is in contact with hair. The mesh structure 110 may be a netting, lightly woven fabric, fabric with a plurality of gaps or holes, or other suitable material allowing air to flow through the mesh structure 110. In one example, the mesh structure 110 may be a woven synthetic mesh fabric, such as polyester, with a plurality of round holes. The round holes may be approximately ⅛ inch in diameter, and a distance between adjacent holes in the x and y directions may also be approximately ⅛ inch. However, other shapes and sizes of openings in the mesh structure 110 are possible. The mesh structure 110 may have moderate levels of rigidity and stretch, allowing some flexibility and movement while maintaining its shape even after multiple uses.

The top 102 may be made of double folded bias tape secured to the mesh structure 110 by a first seam 128. The mesh structure 110 may be secured by the first seam 128 such that the mesh structure 110 is sewn between a front 146 of the top 102 and back 206 of the top 102. A first flexible wire 140 of substantially the same length as the top 102 may be placed inside the top 102. The position of the first flexible wire 140 may be secured within the double folded bias tape by the first seam 128. The bottom 104 may be constructed similarly to the top 102. The bottom 104 may be made of double folded bias tape and secured to the mesh structure 110 by a second seam 132. The mesh structure 110 may be secured by the second seam 132 such that the mesh structure 110 may be sewn between a front 144 of the bottom 104 and back 204 of the bottom 104. A second flexible wire 142 of substantially the same length as the bottom 104 may be placed inside the bottom 104. The position of the second flexible wire 142 may be secured within the double folded bias tape by the second seam 132. The first flexible wire and the second flexible wire may be bendable to allow the hair lengthening device 130 to hold its position when it is wrapped around a section of hair. In an example, the first flexible wire and the second flexible wire may be rubber-coated wire.

The first side 106 may have a plurality of hooks or fasteners attached. The first side 106 may be sewn to the mesh structure 110 by a fourth seam 152 and a fifth seam 154. The hooks may be made of folded wire curved or bent back at an angle. The hooks may each comprise a bent or curved portion and a distal end, and the hooks may be oriented such that the distal end is closer to the second side 108 than the bent or curved portion. Similarly, the bent or curved portion may be closer to the first side 106 than the distal end. The hooks may be a size compatible with engaging with holes of the mesh structure 110. The hooks may be positioned on the front side 126 at regular intervals along the first side 106 between the top 102 and the bottom 104. In one example, hooks may be positioned at two-inch intervals. The hooks may be positioned as close as possible to the first side 106 of the hair lengthening device 130, or may be spaced a set distance from the first side 106 towards a longitudinal midline of the hair lengthening device 130. In one example, the hooks are inset between ¼ inch and ½ inch from the first side 106.

There may be a first hook 112, a second hook 114, a third hook 116, a fourth hook 118, a fifth hook 120, and a sixth hook 122. However, the number of hooks may depend on the spacing interval of the hooks and the length of the hair lengthening device 130. For instance, a hair lengthening device with a greater length may have more hooks than a hair lengthening device with a shorter length, if the two hair lengthening devices have the same spacing interval of hooks. When the hair lengthening device 130 is in use, one or more hooks may be fastened to the mesh structure 110 to secure the hair lengthening device 130 around a section of hair.

The second side 108 may be made of double folded bias tape and may not have any attached hooks or flexible wire. The mesh structure 110 may be secured to the second side 108 by a third seam 148 such that the mesh structure 110 may be sewn between a front 150 of the second side 108 and back 210 of the second side 108.

FIG. 2 is a rear view 200 of the hair lengthening device 130. The hair lengthening device 130 may have a rear side 226 opposite the front side 126. On the rear side 226, the mesh structure 110 may have a wiry or coarse texture as compared to the front side 126 of the hair lengthening device 130.

FIG. 3 is a flowchart depicting a method 300 for using the hair lengthening device 130 to lengthen hair. At 302, the method 300 may include separating hair into one or more sections. In one example, hair is damp at step 302. Damp hair may be, for example, approximately 70%-80% dry compared to when fully wet. In other examples, hair may be dry at step 302. The amount of hair and the number of sections the hair may be separated into may depend on the thickness and length of the user's hair. Further, the number of sections and the arrangement of sections can yield different results. In one example, hair is separated into two sections, one section on each side of the user's head. In another example, hair is separated into four sections, with two placed roughly vertically on each side of the head. Two sections are better suited for longer hair, whereas more than two sections, for example, four sections, may be preferred for shorter hair.

At 304, the method 300 may include selecting one of the sections of hair and placing the hair lengthening device next to the section of hair with the section of hair in contact with the front side 126 of the hair lengthening device 130. The top 102 of the hair lengthening device 130 may be placed close to the scalp of the person applying the hair lengthening device. The hair lengthening device 130 may be placed in such a manner so that the smooth side of the mesh structure 110 faces the section of hair.

Figure 4:
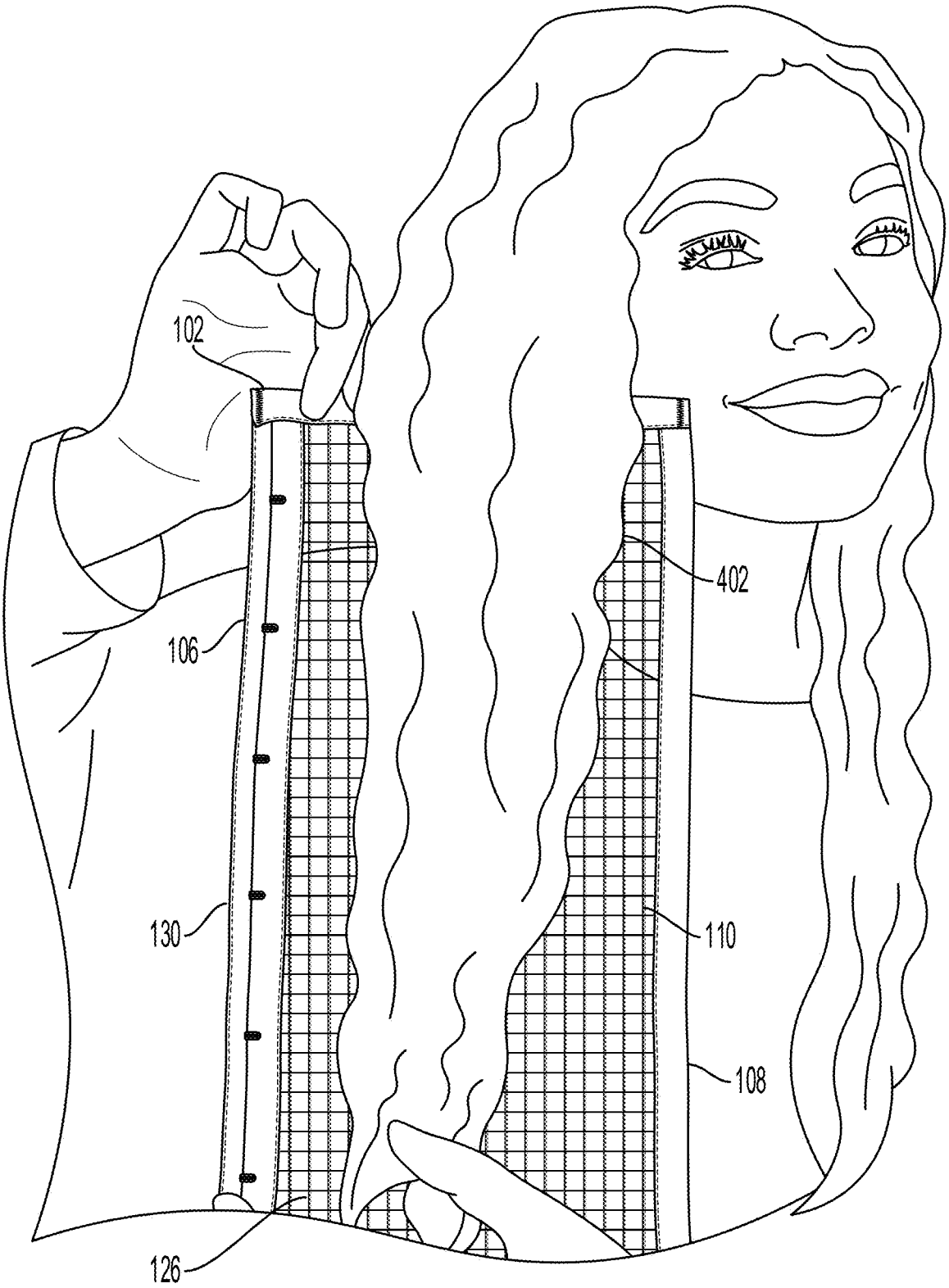
FIG. 4 depicts the hair lengthening device being positioned relative to a section of hair.

Turning briefly to FIG. 4, FIG. 4 depicts step 304 of the method 300. A section of hair 402 is placed upon the front side 126 of the hair lengthening device 130, the length of the hair extending along the mesh structure 110 parallel to the first side 106 and the second side 108. The top 102 is positioned close to the scalp of the user.

Returning to FIG. 3, at 306, the method 300 may include wrapping the top 102 of the hair lengthening device around the section of hair to secure the hair lengthening device 130, via the first flexible wire, to the section of hair. The hair lengthening device 130 may be wrapped in such a manner that the first side 106 that includes the hooks remains exposed while the second side 108 is rolled around the section of hair. In other words, the hair lengthening device 130 may be wrapped starting at the second side 108 and rolled toward the first side 106, so that the hooks along the first side 106 are exposed.

Figure 5:
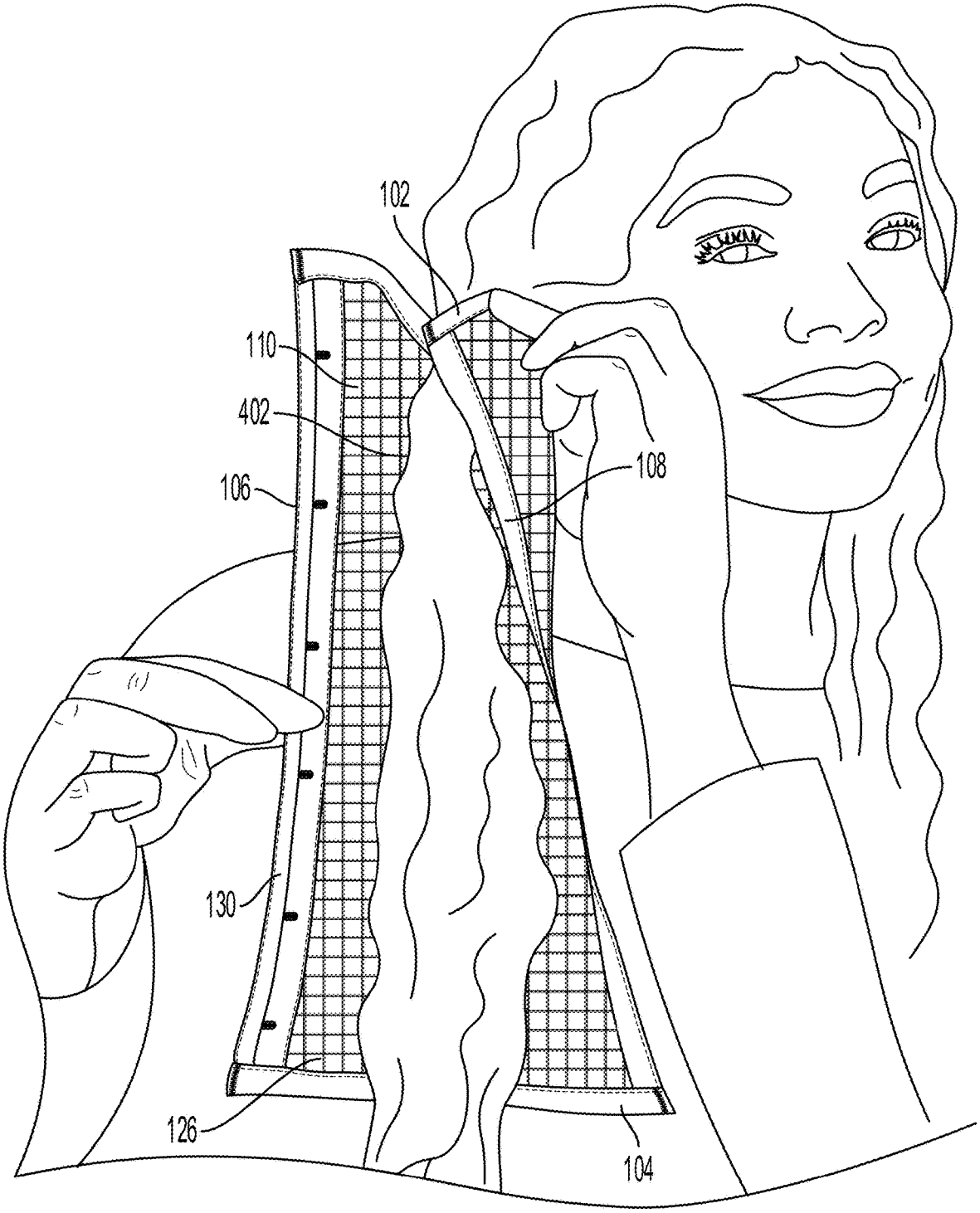
FIG. 5 depicts the hair lengthening device being wrapped around a section of hair.

Turning briefly to FIG. 5, FIG. 5 depicts step 306 of the method 300. The second side 108 of the hair lengthening device 130 is rolled around the section of hair 402 towards the first side 106. The top 102 containing the flexible wire is cinched tightly around the section of hair to hold the hair lengthening device 130 securely in place. The smooth side of the mesh structure 110 is the only side of the mesh structure 110 that makes contact with the section of hair 402.

Returning to FIG. 3, at 308, the method may include securing the hair lengthening device 130 around the hair at a desired tightness by fastening one or more of the hooks to the mesh structure 110. The hooks may be inserted into the holes in the mesh structure 110 to secure them. The hooks may be fastened in order of proximity to the top 102, with the hook closest to the top 102 fastened first. Each hook may be secured to the mesh structure 110 at roughly the same longitudinal position as the hook. Because the hooks may be inserted into any of the holes of the mesh structure 110, the tightness of the hair lengthening device 130 around the section of hair can be controlled by the user. A tighter wrap of the hair lengthening device 130 may result in more lengthening of the section of hair, whereas a looser wrap of the hair lengthening device 130 may result in lesser lengthening. Accordingly, the user can choose the positioning of the hooks based on the degree of desired lengthening.

Figure 6:
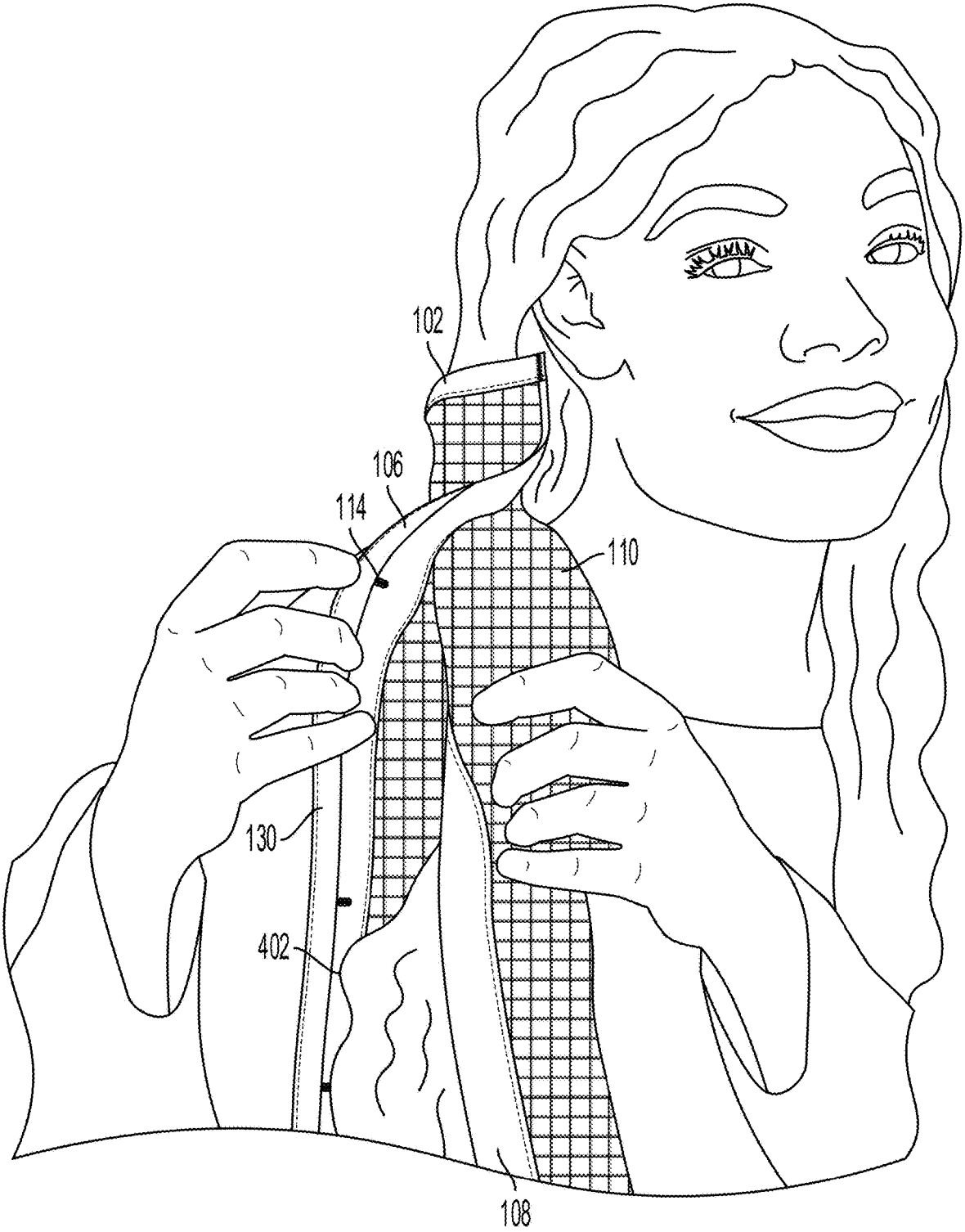
FIG. 6 depicts the hair lengthening device being secured around a section of hair.

Turning briefly to FIG. 6, FIG. 6 depicts step 308 of the method 300. At 308, the hooks are secured to the mesh structure 110. In FIG. 6, the second hook 114 is being held by the user and maneuvered to be hooked into the rear side of the mesh structure 110. In FIG. 6, the first hook 112 (not shown) is already secured to a portion of the mesh structure 110. The hooks may secure the hair lengthening device 130 snugly around the section of hair 402.

Returning to FIG. 3, at 310, the method 300 may optionally include rolling up the bottom 104 of the hair lengthening device to a desired length. In some instances, the hair lengthening device may be longer than the section of hair selected. In these instances, the bottom 104 of the hair lengthening device may be rolled over one or more times to approximately match the length of the hair lengthening device to the length of the selected section of hair. In other cases, hair length may be such that hair extends beyond the hair lengthening device, in which case the bottom of the hair lengthening device may not be rolled upward. In this way, the hair lengthening device 130 may be adaptable for use with different lengths of hair, resulting in simplified manufacturing due to limiting the need to customize the hair lengthening device 130 for the user.

Figure 7:
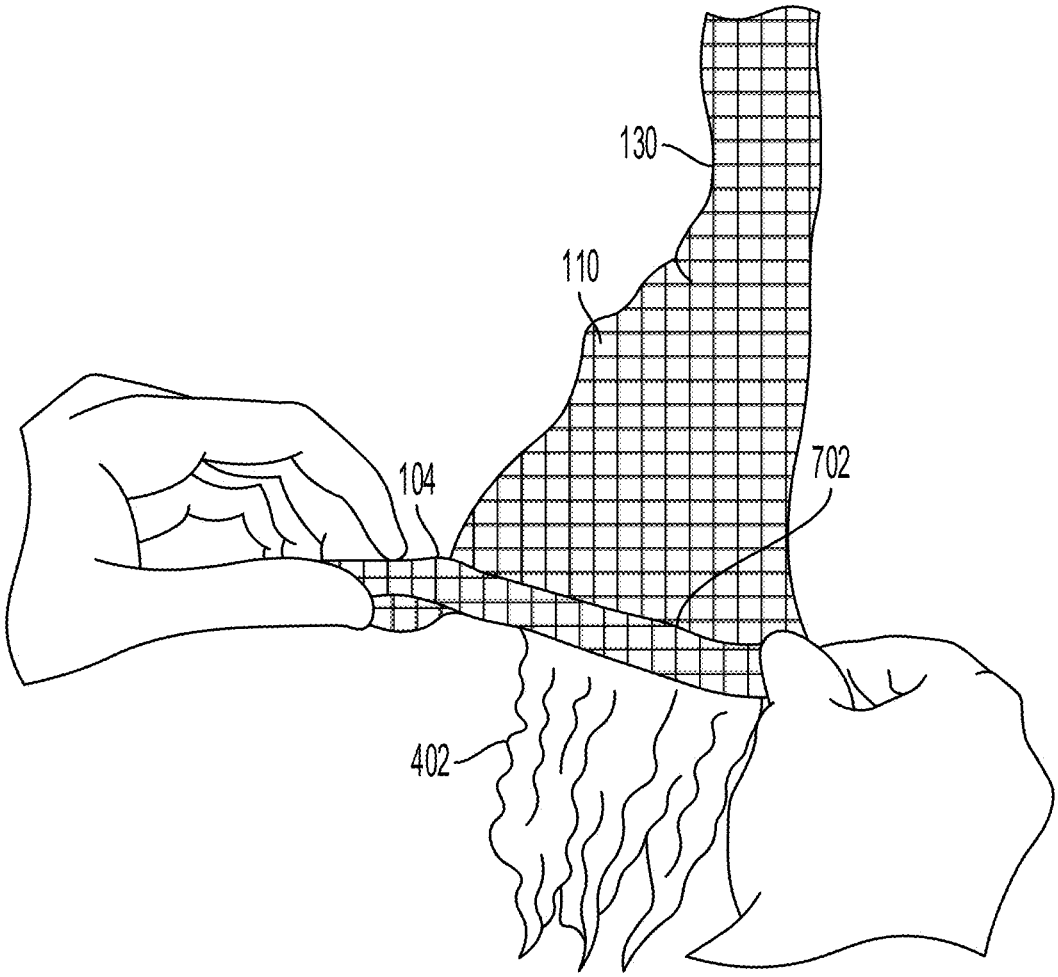
FIG. 7 depicts the hair lengthening device being rolled up to match the length of the section of hair.

Turning briefly to FIG. 7, FIG. 7 depicts step 310 of the method 300. The bottom 104 of the hair lengthening device 130 may be rolled upwards around itself, creating a roll 702 out of a portion of the mesh structure 110. The bottom 104 may be rolled until the section of hair 402 extends slightly longer than the adjusted length of the hair lengthening device 130. In one example, the bottom 104 may be rolled until the section of hair 402 extends one or two inches beyond the rolled edge. The roll 702 may be secured by bending the flexible wire housed within the bottom 104 tightly around the section of hair.

Returning to FIG. 3, at 312, the method 300 may include wrapping the bottom 104 of the hair lengthening device 130 around the distal end of the section of hair to secure the hair lengthening device 130 around the section of hair and maintain the section of hair in a stretched position.

At 314, the method 300 may include determining if a hair lengthening device has been applied to all sections. If a hair lengthening device 130 has not been applied to all sections, the method may return to 304 and may include placing a different hair lengthening device 130 around a different section of hair. If a hair lengthening device 130 has been applied to all sections of hair, the method 300 may continue at 316.

At 316, the method 300 may include waiting a period of time and then removing the hair lengthening devices 130. Waiting a period of time may include drying hair. Hair may be dried with a hair dryer, or be allowed to air dry. In one example, hair may be allowed to dry naturally overnight while the wearer is sleeping. Once the hair is completely dry, the hair lengthening devices 130 may be removed. If the hair lengthening devices 130 were applied to dry hair in step 302, the period of time before the hair lengthening devices 130 are removed may be a period sufficient to ensure lasting results, which may differ person-to-person based on hair texture, thickness, and condition. In general, the hair lengthening devices 130 should remain in hair for several hours or overnight if applied to dry hair. The hair lengthening devices 130 may be removed by reversing the process of positioning the hair lengthening device around the section of hair. For instance, the hair lengthening device may be removed by unwrapping the bottom 104 of the hair lengthening device 130, unhooking the hooks from the mesh structure 110, unrolling the second side 108 from the first side 106, and unwrapping the top 102 from around the section of hair. When the hair lengthening devices 130 are removed, the hair may appear longer than it would have been if allowed to dry without using the hair lengthening devices 130.

Figure 8:
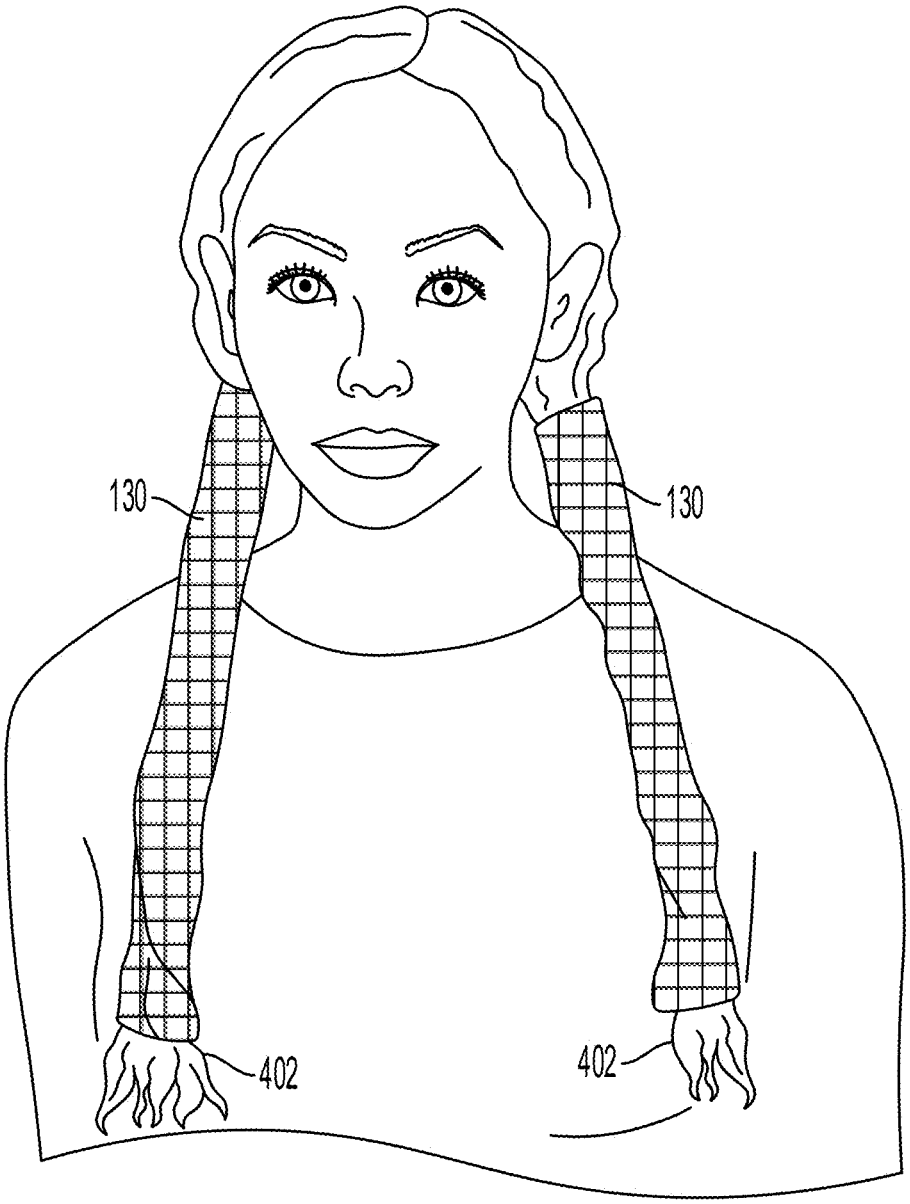
FIG. 8 is an image of multiple hair lengthening devices secured around sections of hair in preparation for drying.

FIG. 8 depicts a user with two hair lengthening devices 130 positioned according to the method of FIG. 3. In this example, two sections 402 of the hair have been secured with hair lengthening devices 130. If damp, the hair may be dried using a hair dryer or by allowing air to naturally pass through the holes in the mesh 110 until the sections of hair 402 are completely dry. When the hair lengthening devices 130 are removed, the hair will remain stretched and appear longer.

FIGS. 1 through 2 and 4 through 8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention claimed is:

1. A method of drying a section of hair in a stretched position, comprising the steps of:

positioning a hair lengthening device comprising a mesh structure extending between a first longitudinal edge and a second longitudinal edge next to the section of hair when the section of hair is wet or damp, wherein a top side of the hair lengthening device is positioned close to a scalp and has a flexible wire configured to hold its shape extending along the top side, and wherein the mesh structure comprises a mesh fabric with a smoother texture on a first face than on a second, opposing face and having a plurality of openings configured to permit airflow therethrough;

wrapping the top side of the hair lengthening device around the section of hair near the scalp to secure the top side in place, wherein wrapping the top side of the hair lengthening device around the section of hair comprises rolling the second longitudinal edge toward the first longitudinal edge such that the first face of the mesh fabric contacts the section of hair;

securing fasteners positioned along the first longitudinal edge of the hair lengthening device to the mesh structure, wherein securing the fasteners to the mesh structure comprises engaging hook elements with the mesh structure, and wherein the hook elements are configured to selectively interlock with any of the plurality of openings of the mesh structure along a width direction, adjustably securing the hook elements within the mesh structure to control a tightness of the hair lengthening device around the section of hair;

rolling a bottom side of the hair lengthening device one or more times toward the top side until a distal end of the section of hair extends beyond the hair lengthening device;

after wrapping the top side of the hair lengthening device around the section of hair, wrapping the rolled bottom side of the hair lengthening device near ends of the section of hair around the section of hair to secure the bottom side in place, the bottom side having a second flexible wire configured to hold its shape extending along the bottom side, wherein wrapping the bottom side comprises bending the second flexible wire around the distal end of the section of hair to maintain the section of hair in a stretched position;

drying the section of hair while the hair lengthening device is secured around the section of hair; and removing the hair lengthening device after a period of time, wherein removing the hair lengthening device comprises unwrapping the bottom side, unhooking the hook elements from the mesh structure, unrolling the second longitudinal edge from the first longitudinal edge, and unwrapping the top side from around the section of hair.

2. The method of claim 1, wherein rolling the bottom side one or more times comprises rolling the bottom side until the bottom side is approximately one or two inches closer to the top side than the distal end of the section of hair.

3. The method of claim 1, wherein securing the fasteners to the mesh structure further comprises securing the fasteners in order of proximity to the top side.

4. The method of claim 1, wherein the mesh structure is made of polyester fabric having a smooth texture.

5. The method of claim 1, wherein drying the section of hair comprises waiting until the section of hair dries naturally prior to removing the hair lengthening device.

6. The method of claim 1, wherein drying the section of hair comprises drying the section of hair with a hair dryer prior to removing the hair lengthening device.

7. The method of claim 1, wherein securing the fasteners to the mesh structure further comprises wrapping the mesh structure tightly around the section of hair and securing the fasteners to a position on the mesh structure that keeps the hair lengthening device tightly around the section of hair, and wherein positioning the hair lengthening device further comprises positioning the top side of the hair lengthening device nearer to the scalp than the bottom side.

8. The method of claim 1, wherein each hook element comprises folded wire curved or bent back at an angle forming a curved or bent portion and a distal end, and wherein each hook element is oriented such that the distal end is closer to the second longitudinal edge than the curved or bent portion.

9. The method of claim 1, wherein the fasteners are positioned on the first face.

10. The method of claim 1, wherein the fasteners are spaced two inches apart along the first longitudinal edge.

11. The method of claim 1, wherein the section of hair is Type 3 or Type 4 curly or coily hair.

* * * * *